US006505762B2

(12) United States Patent
Wilfer

(10) Patent No.: US 6,505,762 B2
(45) Date of Patent: Jan. 14, 2003

(54) BAG FOR A MUSICAL INSTRUMENT

(76) Inventor: Hans-Peter Wilfer, Zum Hackerhof 5, 08258 Markneukirchen (DE)

( * ) Notice: Subject to any disclaimer, the term of this patent is extended or adjusted under 35 U.S.C. 154(b) by 0 days.

(21) Appl. No.: 09/900,547

(22) Filed: Jul. 6, 2001

(65) Prior Publication Data

US 2002/0048414 A1 Apr. 25, 2002

(30) Foreign Application Priority Data

Jul. 7, 2000 (EP) ..... 00114619

(51) Int. Cl.[7] ..... A45F 4/02

(52) U.S. Cl. ..... 224/153; 224/579; 224/627; 224/653; 206/314; 84/453

(58) Field of Search ..... 224/153, 627, 224/578, 579, 653; 206/314; 84/453; D3/204, 216

(56) References Cited

U.S. PATENT DOCUMENTS 4,236,657 A * 12/1980 Brunton ..... 224/153
4,795,030 A * 1/1989 Boyce ..... 206/314
4,883,207 A * 11/1989 McArthur ..... 224/153
4,961,522 A * 10/1990 Weber ..... 224/153 X
5,749,503 A * 5/1998 Wulf et al. ..... 224/153
5,984,154 A * 11/1999 Scicluna ..... 224/627 X
6,172,292 B1 * 1/2001 Dimbath ..... 84/453

FOREIGN PATENT DOCUMENTS

DE 29906764 U1 * 7/1999 ..... 206/314
GB 1238303 * 7/1971 ..... 224/153

* cited by examiner

*Primary Examiner*—Jes F. Pascua
(74) *Attorney, Agent, or Firm*—Sidley Austin Brown & Wood, LLP

(57) ABSTRACT

A bag for a musical instrument, such as a guitar, has at least one carrying belt (19, 20) for shouldering the bag provided at a carrying case (14) in the bag for receiving the instrument. The at least one carrying belt may be inserted into a pocket at the exterior of the case (14) and, for this purpose, can be detached at least at one of its ends from the case.

7 Claims, 5 Drawing Sheets

BAG FOR A MUSICAL INSTRUMENT

FIELD OF INVENTION

The invention relates to a bag for a musical instrument, such a guitar, with a case, formed of a bottom part and a lid part with a lockable opening for inserting or removing the musical instrument. At least one carrying belt is provided on the case for shouldering the bag, with the at least one carrying belt extending between an upper end fastening point and a lower end fastening point. The section between the upper and fastening point and the associated lower and fastening point defines a load carrying section, in which the material of the case is subjected to a special stress. At least one pocket for receiving a detached carrying belt or belts is provided on the exterior of the case.

BACKGROUND INFORMATION AND PRIOR ART

Such a bag is already known from the DE 299 06 764 U I. In the bag described there, the receiving pockets in each case extend on a line defined by the upper and lower associated fastening points. In a special embodiment, the carrying belt together with the lower fastening point, is enclosed in the accommodating pocket.

Although it is surely desirable to stow away the carrying belt or belts when not in use, the previously known solutions have some disadvantages. The arrangement of an accommodating pocket in the region between the upper and the associated lower fastening point is disadvantageous, since this section is to be regarded as a special load section for the material of the case during the transport of the musical instrument stowed in the bag. On the basis of the weight of the bag and the musical instrument alone, the tensile stress on the flexible case is particularly large at the fastening points, especially on the line between the upper and the associated lower fastening points. In addition, this load section is stressed not only especially by the weight of the forces of the bag and of the musical instrument, but also by the loads resulting from the oscillations and vibrations during transport. It, therefore, seems to be problematical to weaken this region in accordance with the state of the art by a belt receiving pocket. The pockets themselves, as well as any fasteners, such as zippers, and the like, are also exposed to unnecessary stresses in this region. Finally, the shouldered transporting of musical instruments, anyhow, is a special burden. In order to offer the greatest carrying comfort, a bag should not have any interfering devices such as a belt receiving pocket with a zipper or the like in the region, in which it comes into contact with the shoulder blades.

OBJECT OF THE INVENTION

It is an object of the present invention to improve a bag for musical instruments, which has at least one receiving pocket for carrying belts, in such a manner in comparison with the state of the art described, that at least one of the interfering aspects named of the previously known pockets can be eliminated or at least mitigated.

SUMMARY OF THE INVENTION

This objective is accomplished in a surprisingly simple manner by a bag embodying the present invention.

A key concept of the present invention lies in that the carrying belts are equipped at least at one of their two ends with detachable fastening means and, at the same time, the receiving pocket is disposed on the exterior of the case outside of the load section. By means of this measure, the carrying comfort during the shouldered transport of the bag is increased significantly. The case is not weakened by additional devices in the load section between the upper and lower fastening points. Finally, the pocket itself is exposed to significantly fewer stresses, if it is disposed outside of this especially stressed region.

The invention is thus based on the realization of disposing the belt receiving pocket not in this specially stressed load section, but at a sufficient distance therefrom and, at the same time, fastening the carrying belts to the case at least at one of the ends with detachable fastening means, so that they can be detached at one or both ends and inserted in the pocket provided for this purpose. Here, as in the state of the art, a partial or preferably a complete, reception may be provided, so that, in the detached state, the carrying belts do not protrude or interfere.

In a particularly preferred embodiment, in each case two upper and lower fastening points are provided at a lateral distance from one another and the at least one receiving pocket is disposed in the region between the two load sections. In this region, the stresses on the material of the case are distinctly less. Moreover, in comparison to the state of the art, the at least one accommodating pocket is located further to the inside, so that the shoulder blades of the user are not affected.

In a concrete embodiment, the two pockets are parallel to one another and can be produced particularly easily. Any seams required can be produced advantageously here.

In a further preferred embodiment, two accommodating pockets are provided directly next to one another. This endows the bag for the musical instrument over all with an ergonomic character and, moreover, can also be regarded as advantageous from a manufacturing point of view.

In an alternative configuration, two or more carrying belts are provided, for which altogether one pocket is formed in the case, so that all the carrying belts required can be accommodated in a single pocket. For this embodiment, only one pocket has to be provided by the manufacturer. The handling is also simplified, since all the required carrying belts can be detached and stowed together in the common accommodating pocket.

In a further particularly preferred embodiment, the belt receiving pocket or pockets are disposed on the exterior of the lid part and the upper and lower fastening points are disposed on the exterior of the bottom part. The fastening points for the carrying belts and the associated pockets accordingly are provided on different sides of the bag for the musical instrument, so that the side, facing the back of a user carrying the bag, does not have an associated pocket. Instead, this accommodating or receiving pocket with its possibly disturbing projection is disposed on the opposite side of the case.

In accordance with a particular advantageous aspect of the present invention, the length of the accommodating pocket is such, that it is at least longer than the distance between the upper end fastening point and the associated lower end fastening point and, in particular, has at least the length of the carrying belt, which is to be stowed. By these means, the carrying belt or belts can be accommodated significantly more conveniently, since the carrying belt or belts does or do not have to be bent or rolled as much.

In accordance with a further advantageous aspect of the invention, the pockets can be closed by VELCRO® fasteners having interengaging elements. In comparison to zippers, VELCRO fasteners interfere far less when the bag is in use, especially when it is being carried.

BRIEF DESCRIPTION OF THE DRAWINGS

The invention is described in greater detail below, also with regard to further distinguishing features and advantages, by means of the description of examples and with reference to the attached drawings in which.

DETAILED DESCRIPTION OF THE INVENTION

Figure 1:
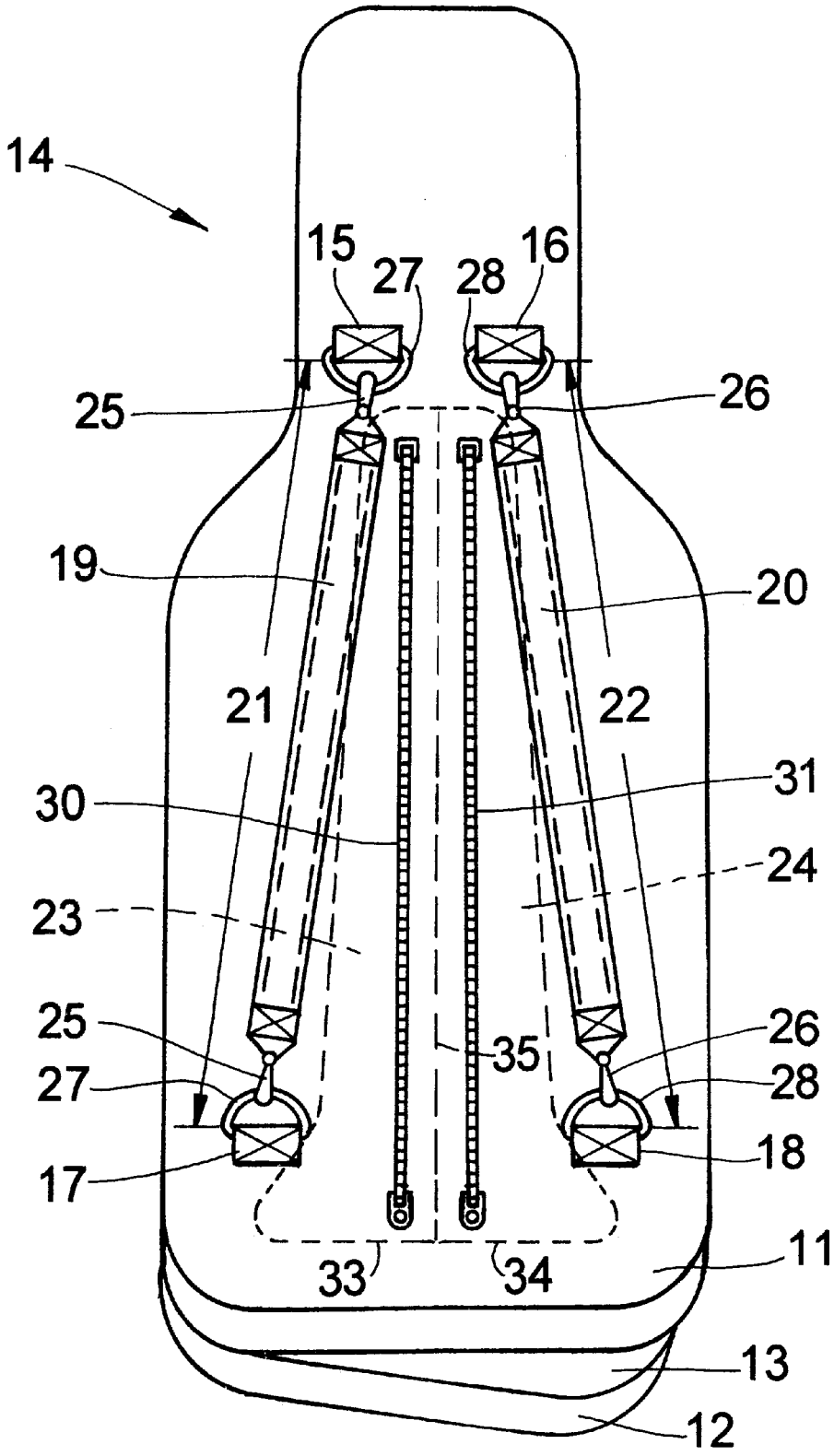
FIG. 1 shows a plan view of a first embodiment of the bag for a musical instrument with carrying belts fastened to fastening points.

In FIG. 1, a first embodiment of the bag for a musical instrument is illustrated with carrying belts 19, 20, fastened to upper end fastening points 15, 16 and lower end fastening points 17, 18. The bag for a musical instrument, such as a guitar, comprises an elongated case 14, which is formed from a flexible material, such as a nylon fabric or the like. The case 14 has two parts, a bottom part 11 and a lid part 12, there being an opening 13 for receiving a musical instrument, such as a guitar, between the bottom part 11 and the lid part 12.

The case 14, together with the musical instrument positioned therein, can be shouldered by the carrying belts 19, 20, which are secured to the fastening points 15 to 18. The section between the upper end fastening points 15 to 16 and the respectively associated lower end fastening points 17, 18 is to be regarded, of course, as a load section 21, 22, in which the material of the case 14 is particularly stressed. Because of the weight of the musical instrument, particularly large tensile forces act in this region more or less linearly. Moreover, this region is particularly stressed by oscillations, brought about by carrying. Finally, the contact between the case 14 and the shoulder blade of the user is particularly close in this region.

The carrying belts 19, 20 are secured over detachable fastening means, which are constructed here as spring safety hooks 25, 26, to fastening means on the case, which are constructed here as eyes 27,28.

Two receiving pockets 23, 24, which are formed with zippers 30, 31 and in which one carrying belt 19, 20, can be stowed, are disposed in the region spaced laterally between the load sections 21, 22, in the present case parallel to the longitudinal median plane of the case 14.

As can be seen from the drawing, the accommodating pocket or pockets 23, 24 extends or extend essentially outside of the load section. In particular, the region of the fastening devices of the pocket, which are constructed here as zippers 30, 31, are disposed completely outside of the load section 21, 22. The fastening devices, which are constructed as zippers 30, 31, extend parallel to one another centrally. The accommodating pockets 23, 24 can be formed by different layers of the material of the case 14, an upper and a lower layer having a peripheral seam 33, 34 for delimiting the receiving pocket. A portion of the peripheral seams 33, 34 may be constructed as a common seam 35.

Figure 2:
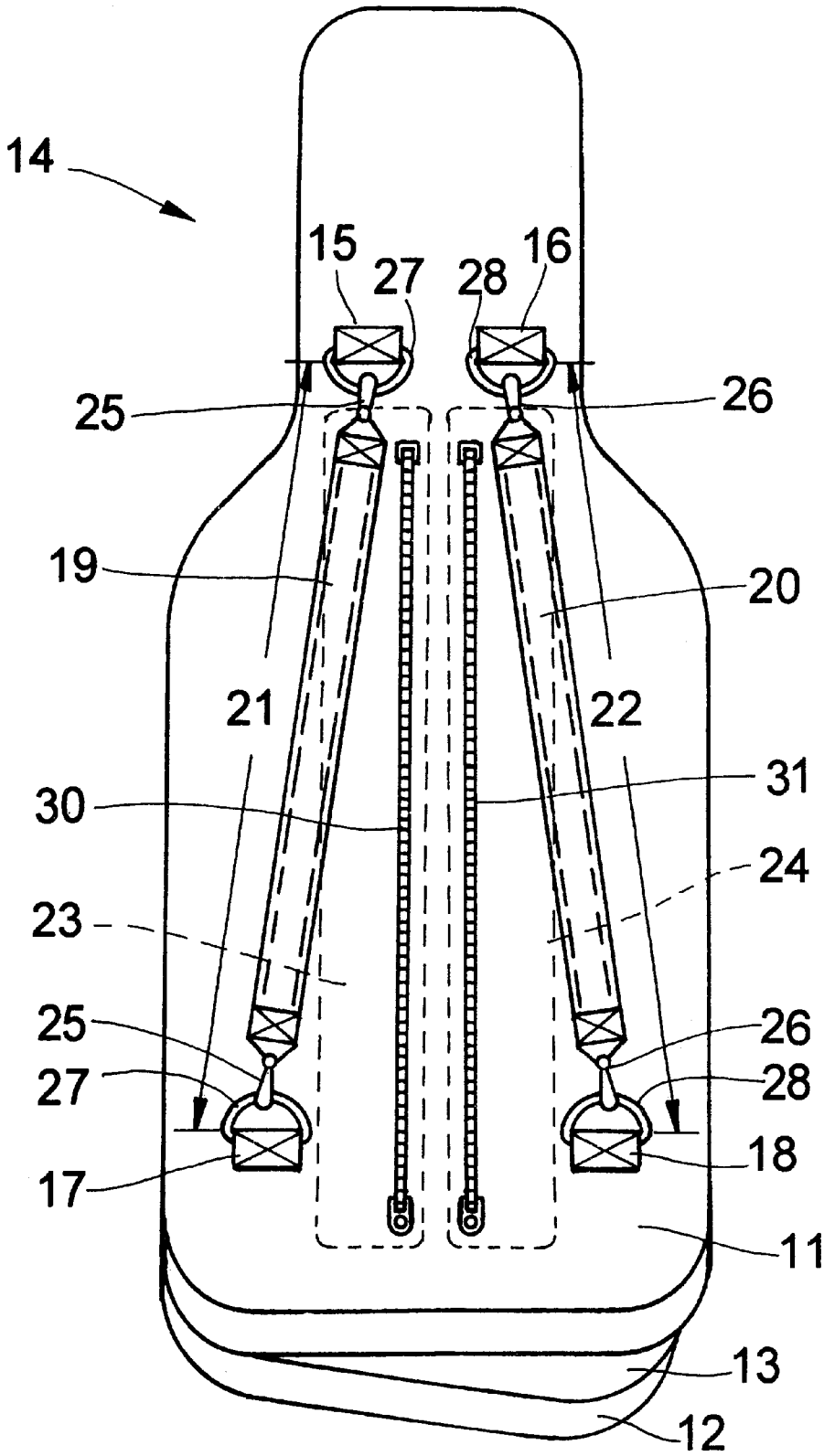
FIG. 2 shows a plan view of a second, alternative embodiment of a bag for a musical instrument.

In FIG. 2, a second, alternative embodiment of a bag for a musical instrument is shown. The explanations relating to the embodiment of FIG. 1 can be referred to with regard to attaching the carrying belts 19, 20. Only the receiving pockets 23, 24 are modified slightly with respect to the receiving pockets of FIG. 1. The pockets 23, 24 here are disposed at a distance from one another without a common seam 35. The peripheral seams 33, 34 do not touch one another. The accommodating pockets 23, 24 of FIG. 2 and the fastening devices, constructed as zippers 30, 31, are longer than the length of the load section 21, 22, so that the respective carrying belt 19, 20 can be stowed even more conveniently.

Figure 3:
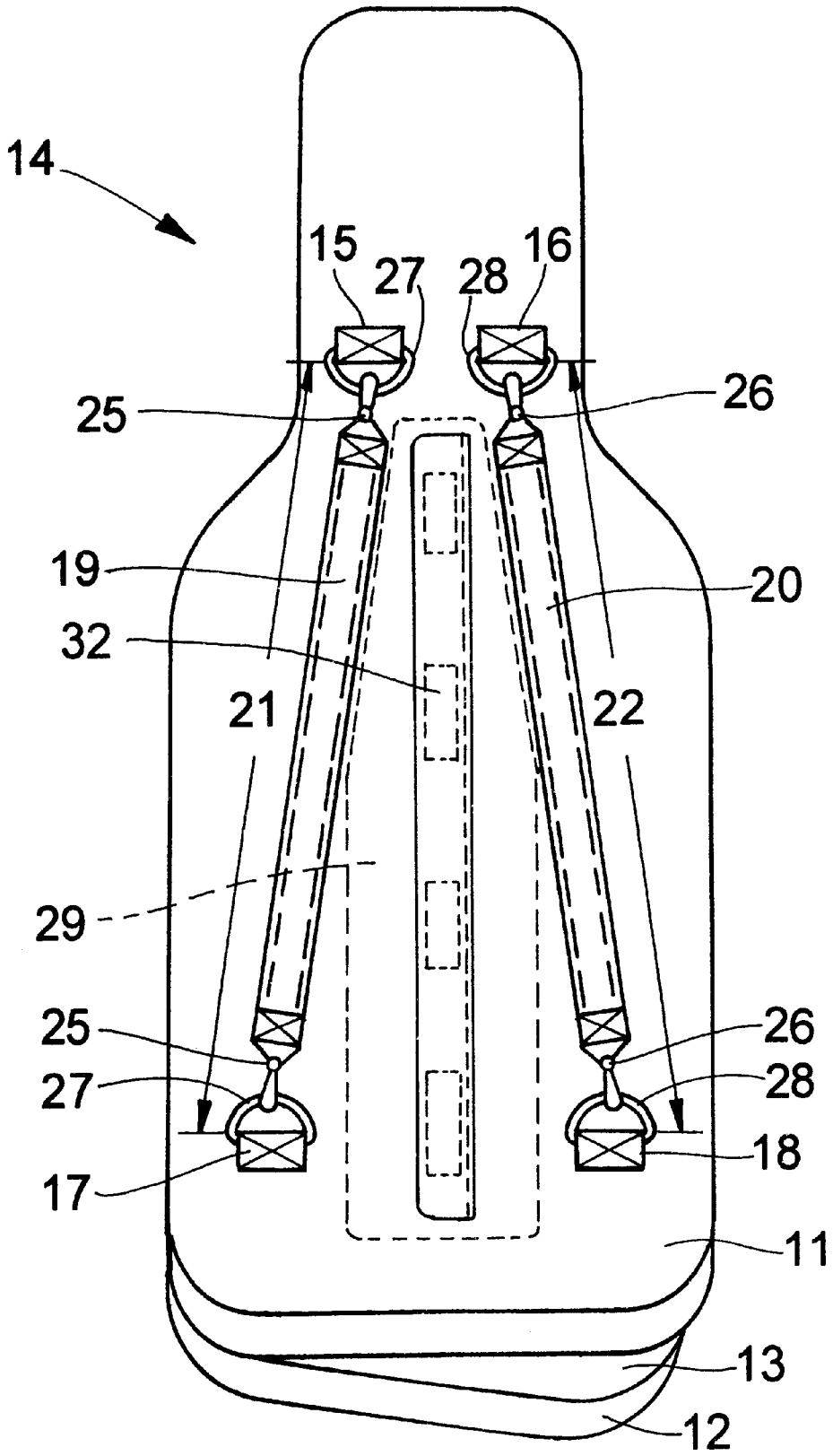
FIG. 3 shows a plan view of a third, alternative embodiment of a bag for a musical instrument.

In FIG. 3, a further, modified embodiment of a bag for a musical instrument is shown, for which, instead of two pockets 23, 24 (see FIG. 1, 2 and 4), only a single (common) pocket 29 is provided for the carrying belts 19, 20. The (common) pocket 29 extends laterally outside of the load sections 21, 22. The fastening device of the (common) pocket 29 is constructed here not as a zipper, but as a VELCRO® fastener 32, the Velcro fastener being longer than the load section 21, 22.

Figure 4:
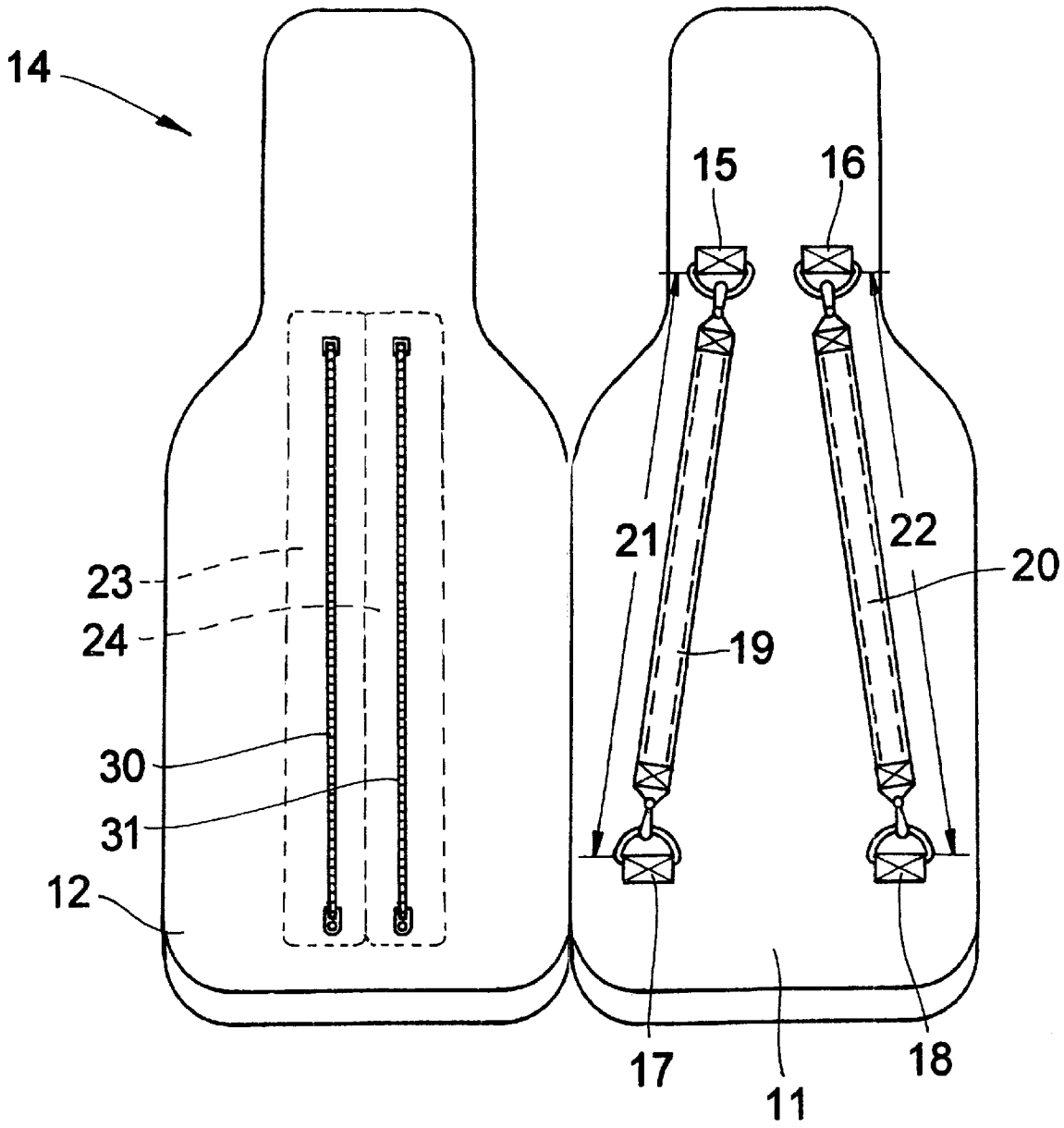
FIG. 4 shows a plan view of a fourth, alternative embodiment of a bag for a musical instrument with the bottom part pivoted from the lid part.

In FIG. 4, a further, alternative embodiment of a bag for a musical instrument, such as a guitar, is illustrated. The bottom part 11 and the lid part 12 are shown here pivoted into the open state, the carrying belts 19, 20 being provided at the bottom part 11 and the pockets 23, 24 at the lid part 12. The receiving pockets 23, 24 of this embodiment extend parallel to one another and are defined in each case by a peripheral seam 33, 34, which forms a section of a common seam 35.

Figure 5:
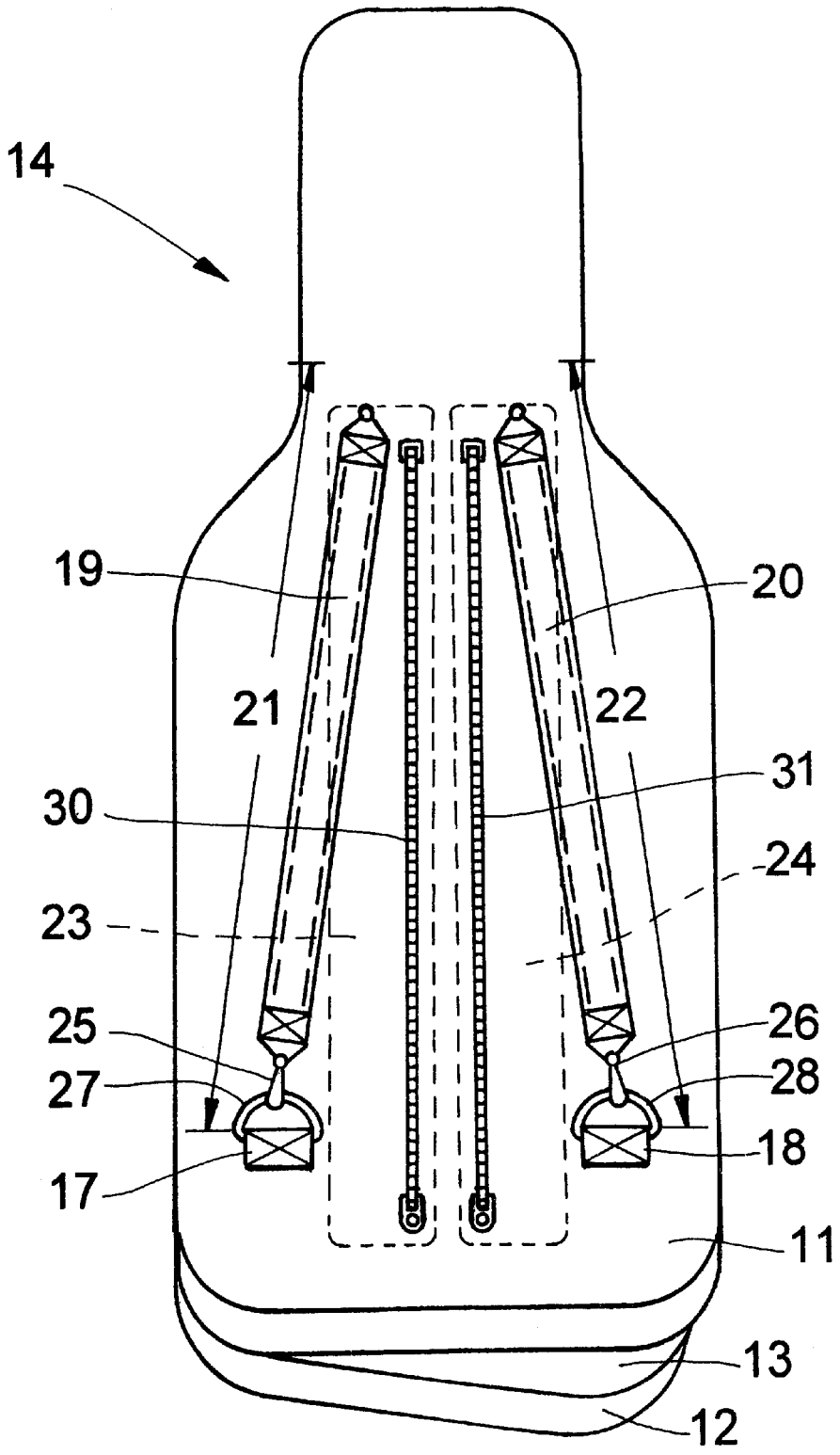
FIG. 5 shows a plan view, similar to FIG. 2 but with the upper fastening means omitted.

The basic concept for all the embodiments shown is that the carrying belts 19, 20 can be detached at least at the upper fastening points 15, 16 and/or at the lower fastening points 17, 18 and subsequently can be inserted into the pocket 23, 24; 29, note FIG. 5, where the carrying belts 19, 20 are secured at the upper fastening points 15, 16 to the lid 12.

What is claimed is:

1. A bag for a musical instrument, such as a guitar, comprises an elongated flexible material carrying case (14), having an upper end and a lower end and including a bottom part (11) a lid part (12) having a lockable opening (13) for inserting and removing the musical instrument, two carrying belts (19, 20) spaced laterally apart and extending between an upper end fastening point (15, 16) and an associated lower end fastening point (17, 18) spaced apart in the elongated direction and arranged to carry the bag on a shoulder, a section of said case extending between the upper end fastening point and the associated lower end fastening point defining an elongated load region (21, 22), in which a flexible material forming the case in said elongated load region is subjected to a particular tensile stress, at least two pockets (23, 24; 29) for holding at least one of the carrying belts (19, 20) and located on an exterior surface of the case (14) and said pockets being spaced laterally from the elongated load region, and of the carrying belts being detachable over fastening means (25, 26, 27, 28) so that the detached carrying belt can be inserted in the associated pocket, said two pockets are arranged parallel to one another in the elongated direction of said spaced apart between said two load regions.

2. A bag as set forth claim 1, wherein said two pockets (23, 24) are disposed immediately adjacent to and laterally of one another.

3. A bag as set forth in claim 1, wherein said two pockets (23, 24; 29) are located on the exterior surface of said lid part (12) and said upper end fastening and lower end fastening points are located on the exterior surface of said bottom part (11).

4. A bag as set forth in claim 1, wherein the length of said two pockets is greater than the length between said upper end fastening points (15, 16) and the associated said lower end fastening points (17, 18).

5. A bag as set forth in claim 1, wherein said carrying belts (19, 20) are detachable at both opposite ends from said case over said detachable fastening means and insertable completely into the associated pockets (23, 24; 29).

6. A bag as set forth in claim 1, wherein said carrying belts are detachable only from said case (14) at one of said upper end and lower end fastening points and can be inserted from the free end thereof at least partly in one of said pockets (23, 24; 29).

7. A bag as set forth in claim 1, wherein said pockets (23, 24; 29) are closed by a fastener (32) having interengaging elements.

* * * * *